United States Patent [19]

Leaver

[11] Patent Number: 4,691,490

[45] Date of Patent: Sep. 8, 1987

[54] CEMENTITIOUS MODULAR PANEL AND PANEL ASSEMBLY FOR BUILDING WALLS AND METHOD OF CONSTRUCTION

[76] Inventor: James M. Leaver, 4145 Canyon Rd., Lafayette, Calif. 94549

[21] Appl. No.: 825,080

[22] Filed: Jan. 31, 1986

Related U.S. Application Data

[63] Continuation of Ser. No. 419,746, Sep. 20, 1982, abandoned.

[51] Int. Cl.[4] ..... E04B 2/00

[52] U.S. Cl. ..... 52/293; 52/309.17; 52/393; 52/584; 52/599

[58] Field of Search ..... 52/293, 309.16, 309.17, 52/393, 405, 584, 630, 294, 299, 601, 599, 600, 602, 403, 396

[56] References Cited

U.S. PATENT DOCUMENTS

| | | | |
|---|---|---|---|
| 1,699,651 | 1/1929 | Bennett | 52/293 |
| 2,854,565 | 9/1958 | Kruger | 52/393 |
| 3,995,080 | 11/1976 | Cogburn | 52/630 |
| 4,164,831 | 8/1979 | Messick | 52/405 |
| 4,185,437 | 1/1980 | Robinson | 52/601 |
| 4,223,502 | 9/1980 | Robinson | 52/315 |
| 4,278,468 | 7/1981 | Selbe et al. | 52/317 |
| 4,299,171 | 11/1981 | Larson | 52/309.16 |
| 4,301,628 | 11/1981 | Lowe | 52/630 |
| 4,312,904 | 1/1982 | Meyer | 52/309.17 |
| 4,316,995 | 12/1982 | Buck | 52/309.17 |
| 4,404,158 | 9/1983 | Robinson | 264/263 |

FOREIGN PATENT DOCUMENTS

| | | | |
|---|---|---|---|
| 436584 | 10/1935 | United Kingdom | 52/584 |
| 1239792 | 7/1971 | United Kingdom | 52/293 |

OTHER PUBLICATIONS

"Recommended Practice for Glass Fiber Concrete Panels" (GFRC Panel) pub. by Prestress Concrete Institute, Journal of the Prestress Concrete Institute, vol. 26, No. 1, Jan.-Feb. 1981.

*Primary Examiner*—J. Karl Bell

*Attorney, Agent, or Firm*—Joseph L. Strabala

[57] ABSTRACT

A modular panel of glass fiber reinforced concrete having a thickness of at least ⅜ inch, and containing four (4) to six (6) percent glass fiber and at least fifty (50) percent by weight cement, has upstanding edges forming flanges oriented normal to the plane of the panel and a thickness equal to the thickness of the panel, which flanges on contiguous panels can be joined to form a composite wall structure by bolting said flanges together. The novel panel and flange arrangement allows self-supporting wall structures to be constructed wherein only lateral loading (normal to the plane of the wall) need be carried by the adjacent framework. An elastomer gasket is used between the flanges to accommodate expansion and contraction of the individual panels in a composite wall of the panels.

The invention includes composite walls of a plurality of the panels and a building structure employing such composite walls, with an adjacent framework and the interconnective arrangements between these several components.

17 Claims, 11 Drawing Figures

CEMENTITIOUS MODULAR PANEL AND PANEL ASSEMBLY FOR BUILDING WALLS AND METHOD OF CONSTRUCTION

This is a continuation of Ser. No. 419,746 filed Sept. 20, 1982 now abandoned.

Further disclosed is a method of building a building employing the above-described components.

BACKGROUND

New techniques and materials with cementitious base have been developed recently in the building industry. Important among these is the material known as glass fiber reinforced concrete, sometimes referred to as GFRC. Glass fibers, often used to reinforce plastics are acceptable to reinforce concrete, but experience demonstrated that the conventional glass fibers were subject to alkaline attack, which not only destroyed the bond between portland cement and glass fibers but also structurally weakened the glass fibers.

Alkali resistant glass fibers were developed in the late 1960s and polymers were used in the 1970s to reduce the alkaline attack on the glass fibers. These developments led to the development of glass fiber reinforced concrete panels for building curtain wall applications, i.e., where panels fastened to on the building's structural framework to form an exterior cladding of the structure. Due to the availability of thinner GFRC wall in GFRC panels which results in lighter weight panels, they have become attractive for fabricating cladding on high rise office buildings.

An excellent article on GFRC panels was published by the Prestress Concrete Institute entitled "Recommended Practice for Glass Fiber Concrete Panels." It was prepared by the PCI Committee on Glass Fiber Reinforced Concrete Panels, and published in the Journal of the Prestress Concrete Institute, Vol. 26, No. 1, Jan-Feb, 1981.

Portland cement composites used to form GFRC panels typically consist of about 5% by weight of alkali resistance glass fiber combined with portland cement and aggregates, such as sand, and may include additives. Trained operators can spray up the GFRC panel by directing a hetrogenous spray of cement slurry, aggregate, and chopped glass fibers into a generally horizontal mold of the desired shape, size, etc. The chopped glass fiber will be randomly distributed in the resulting matrix formed in the mold.

Because of the strength of the above matrix, GFRC panels can have nominal wall thickness from $\frac{3}{8}$ inch (9.5 mm) to 1 inch (25.4 mm) and a large range in size and shape, which is compatible with the mold and release therefrom. Curtain walls, sometimes referred to as exterior cladding panels, when made with GFRC will have only 1/10 to $\frac{1}{3}$ the weight of comparable precast concrete panels. Further, the GFRC panels can be stiffened by forming integral ribs in the panels by laying longitudinal styrofoam battens on the freshly cast panel and overspraying the battens with $\frac{3}{8}$ to $\frac{1}{2}$ inch of the mixture, thereby encasing the batten. Cladding units generically include wall panels, window wall units, spandrels, mullions and column covers.

In the past, such cladding units have included inserts embedded in the panel for attaching them to the framework to which they are fastened like a picture frame. All insert devices incorporated into the panel must be corrosion resistant. Zinc or cadmium coated ductile steel is satisfactory but consideration must be given to the thermal compatibility of the insert if the GFRC panel is fire rated. Improper embedment of the inserts will lead to serious failures; further, care must be taken to have the insert extend above the panel so any bolting against the insert and the attaching structure will not place the portion of the panel covering the insert under substantial stress, since this will cause a failure.

The attachment of the inserts of the panel to the supporting structure must also allow for dimensional movement of the panel caused by creep, thermal movement and structure tolerances. Thus, slotted and/or oversized apertures in the inserts are employed to suspend the individual GFRC panels in spaced relationship to the adjacent panels, i.e., leaving gaps between their edges. Thereafter, the longitudinal spaces or gaps between the panels are sealed with a mechanical packing and/or sealant. It is recommended that the joints be packed with fiber felt followed with a flexible polyethylene back up rod and then faced on the outside surface with a sealant.

While the above prior art GFRC panels have found acceptance and filled certain architectural requirements, the techniques are costly and restricted to the more expensive type of high rise construction with heavy steel framework to carry the load induced by the weight of the panels.

The current invention involves a type of GFRC panel configuration which eliminates the need for embedded inserts, allowing the novel panels to be bolted together in a building wall structure wherein the panels are self-supporting vertically, with only lateral support provied by a contiguous light weight frame structure. This invention is a substantial departure from the existing state of the art of GFRC panels and is achieved by special panel design, construction and a novel joint arrangements, along with a unique fastening arrangement to the contiguous building framework whereby only lateral loading is transmitted to the framework.

It is an object of this invention to take advantage of the high compressive strength of GFRC panels by a design which creates a selfload bearing wall composed of a plurality of GFRC panels bolted together, as well as a method to create one or more than one such walls to form a building structure.

Beyond the above advantages, this invention provides the elements and method whereby lower cost, more energy efficient and architecturally aesthetic buildings can be constructed.

SUMMARY OF THE INVENTION

The instant invention includes an improved building panel unit for assembly into self-supporting walls by joining a plurality of said panels together to form a composite wall by bolting them together, which unit includes a panel structure with a thickness of at least $\frac{3}{8}$ inch formed of glass fiber reinforced concrete containing from four (4) to six (6) percent fiberglass by weight, and at least fifty (50) percent by weight of cement, the panel having at least one flange along one of its edges, the flange having a thickness at least equal to the panel thickness, and the flange oriented normal to the flat surface of said panel and formed integral therewith.

It also involves an improved self-supporting modular building wall composed of cementitious panels comprising at least two separate panel units each of the panel units consisting of a panel structure with a thickness of at least $\frac{3}{8}$ inch formed of glass fiber reinforced concrete containing approximately four (4) to six (6) percent glass fiber by weight and at least fifty (50) percent by weight of cement, each of the panel structures having at least two flanges along its opposite edges of a thickness at least equal to the thickness of the panel, the flanges oriented normal to the surface of said panel and formed integral therewith, with the panels joined along one of their flanged edges to another panel by bolt means holding the flanges together to form said modular wall structures.

Further, the invention involves an improved building structure having at least one wall formed of a plurality of cementitious panels which are bolted together including a foundation; a building framework suitable to support the roof and wind loads of said buildings assembled on the foundation; a plurality of cementitious panels, each of the panels consisting of a panel structure with a thickness of at least ⅜ inch formed of glass fiber reinforced concrete containing approximately four (4) to six (6) percent glass fiber by weight and at least fifty (50) percent by weight of cement, each of the panels having at least two integral flanges along its edges, each of said flanges having a thickness at least equal to the thickness of the panel structure and oriented normal to the surface of said panel structure, the panel structures being stacked vertically on said foundation in rows whereby a first row of panels supports a second row of panels with the flanges of said panels aligned with one another; gasket means separating the flanges of said panels to provide for expansion and contraction; bolt means extending through the flanges of the panel structures and operable to join the panels into a wall structure composed of a plurality of the panel structures; alignment means attaching said panels to said framework of the building to fix the vertical alignment thereof normal to the plane of the wall structure, said alignment means allowing two degrees of freedom of movement between the panel and the framework but restricting any lateral movements normal to the plane of the resulting wall structure; means attaching the lower row of panels to the foundation.

It also includes a method of constructing a building out of a plurality of cementitious panels, including the steps of forming a plurality of cementitious panels with integral flanges by spraying a slurry cement and alkaline resistant fiberglass into molds to form flat panel-like structures having a thickness of at least ⅜ inch and flanges normal to the surface of said panel at least two (2) inches in height, the panel being bounded along its edges by the flanges; forming a foundation and assembling thereon a framework to support lateral wind loadings on walls adjacent to the framework; assembling said plurality of the panel structures on the foundation in rows and with bolt means securing flanges of the panel structures together to form a composite wall structure with each subsequent row of panel structures being supported on the prior row; attaching the resulting joined panel structures to the framework with attaching means of allowing at least two degrees of freedom for expansion and contraction of the resulting composite wall, the attaching means preventing the wall from deviating from vertical alignment normal to the wall plane while allowing said two degrees of freedom.

DESCRIPTION OF THE DRAWINGS

The invention will be better understood by reading this specification in conjunction with the attached drawings wherein.

DESCRIPTION OF THE CURRENT EMBODIMENTS OF THE INVENTION

Figure 1:
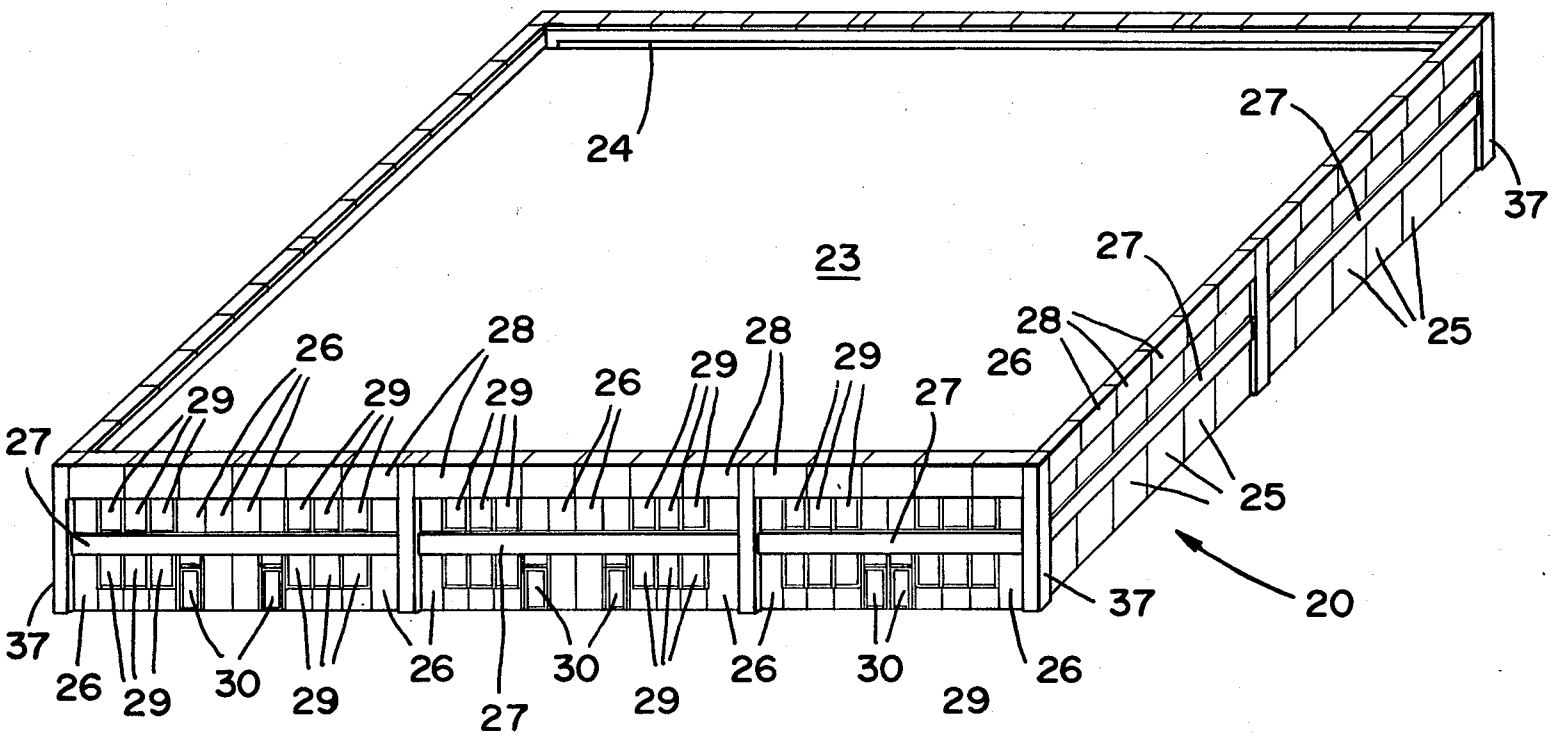
FIG. 1 is a perspective of a building constructed with the novel panels of this invention showing its modular character.

An illustration of a type of building which can be constructed with the novel GFRC panels of the current invention when using techniques and methods of this invention is shown in FIG. 1. It shows a two-story office building 20 with a front 21 sides 22 and a sloping metal roof 23 with a gutter 24 along with one edge. The front sides and rear walls are composed of similar modular units. These units are composed of vertical GFRC panels 25 and 26 and horizontal GFRC panels 27. At the top of the wall is the parapet GFRC panel 28.

Because of the modular construction panels 26 and/or 27 can be removed and window and door components 29 and 30, respectively, can be substituted for these panels, as shown in the front 21 of the building 20. The structural arrangements allowing such substitution of components for panels is described subsequently and provides unusual flexibility in the building design.

Figure 2:
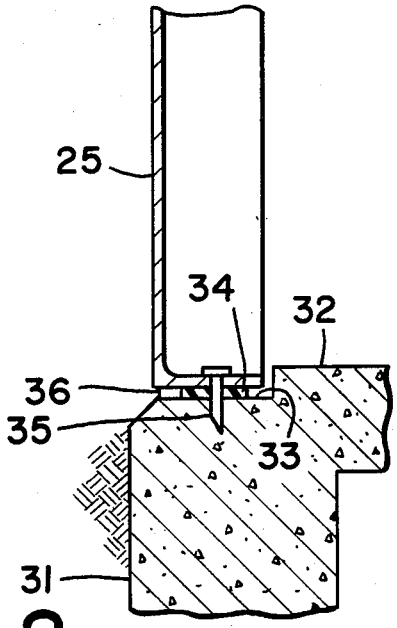
FIG. 2 is an enlarged section of the base of the load bearing wall structure constructed of a plurality of GFRC panels, illustrating its simple attachment to the foundation.

Referring to FIG. 2, the base of the self-supporting wall structure is shown in detail. A foundation 31 is poured and includes step 32 which leaves a lower ledge 33 on which panel 25 rests. If this ledge is leveled the panel can be assembled on a gasket strip 34, such as of Neopreme® strip ¼ inch thick and from two (2) to six (6) inches wide and secured by a stud 35, which can set in the foundation with an expansion anchor bolt. Alternatively such studs can be pre-set when the foundation is poured. If the ledge is not leveled, the panel 25 can be shimmed level and then grouted with a grout mix 36. The gasket strip and/or the grout together with the step 32 form a water seal at the bottom of the wall that prevents the ingress of water.

In the GFRC panels used in the illustrated building, their weight is approximately 8 to 10 pounds per square foot. Thus, designs are adopted to take advantage of the compressive strength of GFRC which has an average minimum value of approximately 2,000 psi. In a two-story structure wall thickness of ½ inch (12.7 mm) in the first story panels is more than adequate to carry the dead load self weight of both the lower panel and those upper panels supported thereon. Corner column covers 37 are used to finish off the corners of the structure (see FIGS. 8 and 9).

Figure 3:
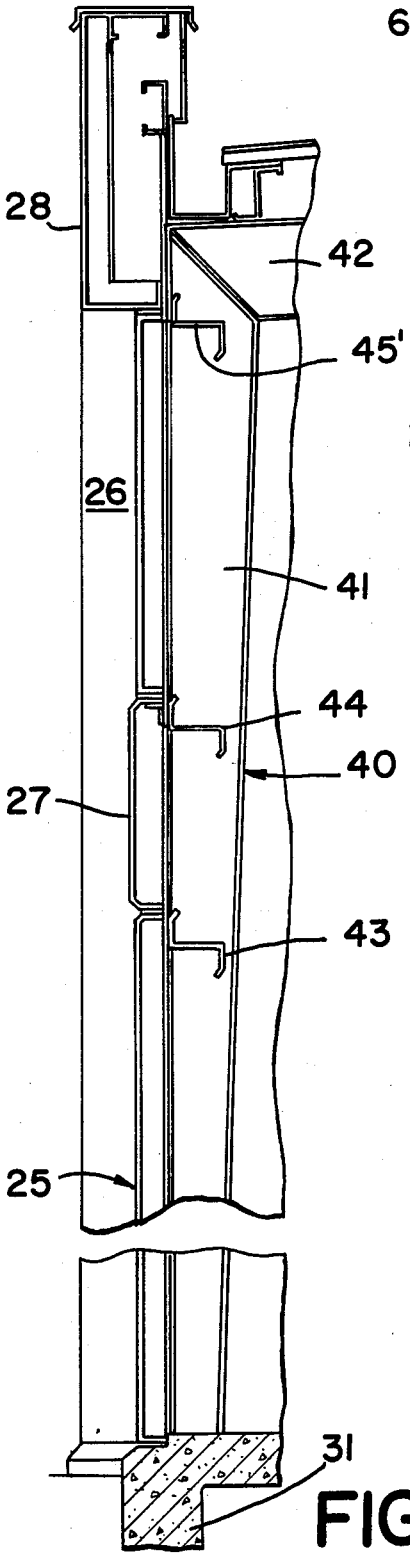
FIG. 3 is a section of the self-supporting wall of this invention constructed with the GFRC panels showing the wall's relationship to the adjacent steel frame structure.

To better understand the wall composite, reference is made to FIG. 3 illustrating a two-story wall structure in section composed of the bottom panel 25, intermediate elongated panel 27 and upper panel 26. As can be seen, panel 25 assembled on the foundation in a row of similar panels, supports the upper panels 26, 27 and 28 which are stacked vertically on one another. All panels have flanges at their perimeter edges that extend normal to the panel's surfaces and projecting from the rear face of the panel. The actual panel design and its specifications will be discussed later, but is is important to note the rim flanges 25*a*, 26*a*, 27*a* and 28*a* are integral parts of each panel and are utilized to join the several panels in the wall structure shown in FIG. 3, as well as to assist in forming the wall support on the foundation, as shown in FIG. 2.

Alongside the vertical stacked panels 25, 27 and 27, shown in FIG. 3, is the parallel structural framework 40. It consists of vertical frames 41 that join with the roof structure 42 to support the roof and ceiling of the building. The vertical frames are at spaced intervals and have horizontal girts 43, 44 and 45 spanning between them. Typical spacing of the frames would be on 16-foot to 24-foot centers and the lower girt 43 is set at a height of approximately 8 feet. One can use intermediate girts for interior framing for sheet rock, if desired.

Figure 4:
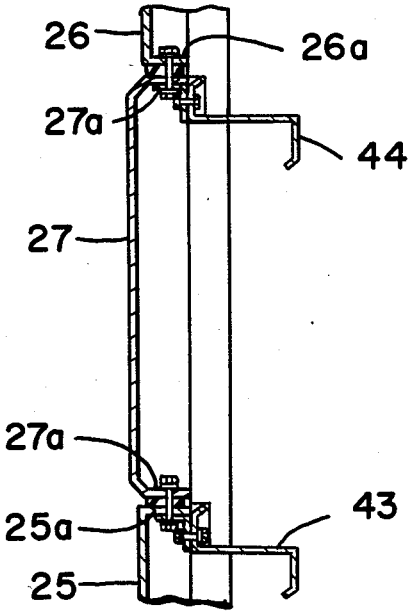
FIG. 4 is an enlarged section of the middle portion of the wall shown in FIG. 3.

As can be seen, the vertical arranged panels 25, 26, 27 and 28 are stacked on the lower row of panels and are not "hung" on the framework 40. The panels are self-supporting, placing the lower and intermediate panels in compression. The steel framework is only used to support the panels laterally, i.e., when the panels are subject to wind loading, through the special joint arrangement, best shown in FIGS. 4, 6 and 7.

Figure 7:
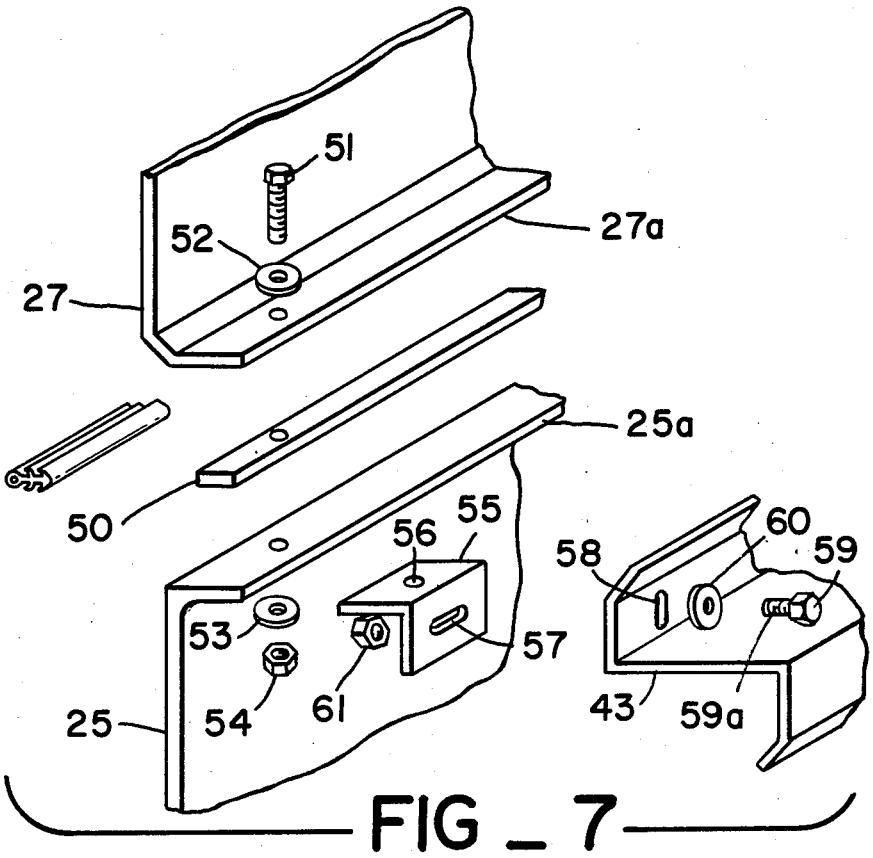
FIG. 7 is an exploded perspective of the joint shown in FIG. 6.

More particularly, the GFRC panels are stacked vertically in rows with their respective flanges in registry with an elastomer gasket 50 inserted therebetween to separate the parallel flanges, as can be seen in FIG. 7. The gasket 50 need not be continuous and once the flanges are aligned, if holes are not predrilled a bit is used to drill bolt holes through aligned flanges 27*a* and 25*a*. Further, the bolt should fit the hole leaving only a small clearance, i.e., 7/16 inch bit is used for a ⅜ inch bolt. Thereafter, a bolt 51 with washer 52 is inserted into the aligned holes and a second washer 53 is added before self locking nut 54 is tightened to join the panels. These washers can include an elastomer washer (not shown) if desired. This technique is used to join both the aligned horizontal as well as the aligned vertical flanges of the panels. Bolts from 14 to 32 inch centers along the flanges are adequate and the elastomer gaskets 50 of a thickness of approximately ¼ to ½ inch and a width from 1 to 3 inches are used between the vertical aligned flanges as well as the horizontal aligned flanges. Elastomers such as Neopreme ® are suitable. While conventional bolts are shown, other bolt means can be used to join the flanges, i.e., rivits, etc.

Along the horizontal flanges L-shaped brackets 55 are used at spaced intervals in place of washers 53 to connect the panels to the horizontal girts. An aperture 56 in one flange of the bracket is received on the bolt 51 and thereafter the nut 54 and washers are used to cinch the bracket against the flange (see Fig. 6) with the gasket 50 and elastomer backed washers providing the necessary resilience in the connection. Generally, the bolts are ⅜ inch to ⅝ inch in diameter and are torqued to less than 5-foot pounds. Bolts larger than ⅜ inch diameter are acceptable, but smaller diameter bolts may not have the necessary purchase.

The other flange of bracket 55 includes an elongated slot 57. This slot mates with a similar elongated slot 58 formed in the girt 43 except it is oriented normal to slot 57. When bolt 59 is inserted in the crossed slots with a bellville washer 60 attached, to nut 61 can be tightened against the shoulder 59*a* to secure the bracket to the girt 43. The bellville washer provides a substantial loading on the connection but allows movement between the bracket and the girt to accommodate thermal expansion and contraction. The crossed slots allow two degrees of freedom in the connection.

At this juncture it should be noted that the panels are securely bolted together to form a wall with elastomer gaskets between them. The wall has dynamic movement while expanding and contracting both vertically and horizontally. The special joints with the framework described above accommodate this dynamic movement. Of course, the design of the mechanical connection to the framework can be changed, so long as the proper two degrees of freedom is maintained. For example, simple flat metal straps can be used with the pivoting action on bolts connecting it to the framework and the panels providing one degree of freedom and deflection of the strap providing the other. However, any attaching device effecting the connection of the panels to the framework must maintain the panel wall vertical and withstand the lateral loading, i.e., the wind loading.

Since the panel wall is literally a "bolted" together composite of smaller panels, no special equipment, such as a crane is required to assemble them. Normally, the lower panels 25 are 4 foot by 8 foot, the horizontal panels 27 are 3 foot by 8 foot, and the upper panels 27 are 4 foot by 5 foot. Typical weights of these panels would be 320 pounds, 240 pounds, and 200 pounds, respectively. Thus, simple lifts secured on the framework 40 are adequate to handle the upper panels 26, 27 and 28. Two men can tilt up the lower panels 25 on the foundation 31. Also, it should be appreciated that the elongated panels 27 are twice the width of the lower panels 25, enabling one of the lower panels to be removed with the cantilevered portion of panel 27 supporting the upper panels 26 and 28. Thus, doors and window panels can be utilized in place of the GFRC panel modules. Typically, these window and door structures are designed to take the loading, i.e., support the weight, of the upper panels and may include smaller submodules made by the same method as the standard modules. Sub-modules 29*a* can be seen in FIG. 1 associated with windows 29.

Once the panels 25, 26 and 27 are assembled the parapet panel 28 is assembled on the top of the upper panel 26 in the manner described above.

Figure 5:
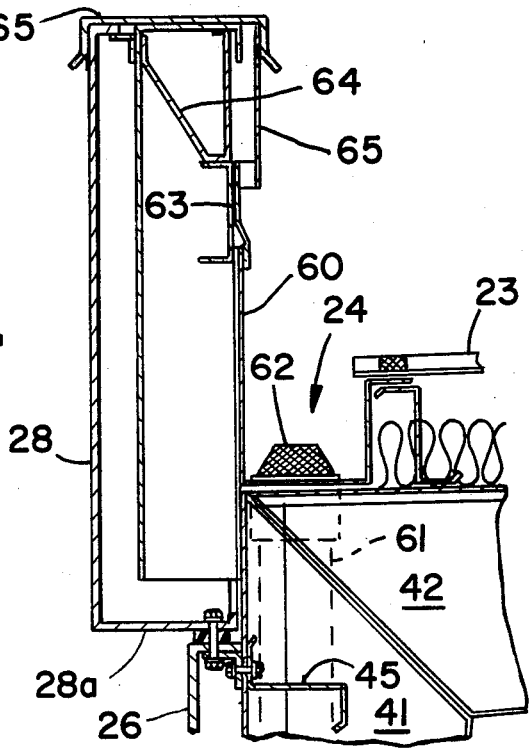
FIG. 5 is an enlarged section of the top portion of the wall shown in FIG. 3.

The detail of the gutter 24 is best shown in FIG. 5. It is formed of standard flashing 60 bent into a U-shaped trough installed with a slope to a drain pipe 61 capped by a debris screen 62. It is installed between the sloping roof 23 and parapet structure as shown. Panel 28 forming the parapet has an extended flange 28*a* allowing this panel to be offset from the plane of the wall formed by panels 25, 26 and 27 (see FIG. 5) to provide architectural relief to the structure. This is possible since the flange 28*a* only needs to carry the dead load of the parapet panel.

This dead load is carried by lower panel 26 and the details of the joint between the panels is constructed as previously described. The top of the parapet panel is secured by bolting it to eave strut 63 that is attached to the framework 40. A strap 64 holds the top of this panel in position and a multi-piece flashing 65 covers the top as shown in FIG. 5.

Figure 8:
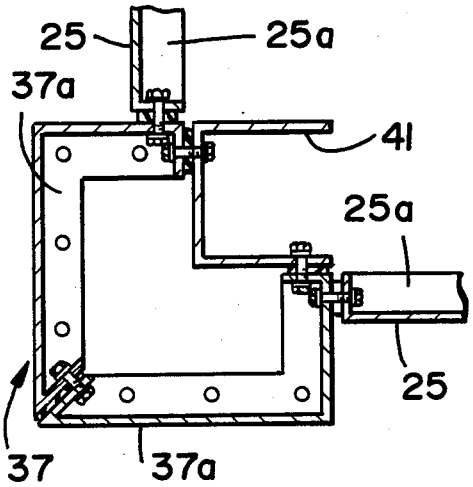
FIG. 8 is a cross-section of a GFRC corner column cover formed of two pieces that are bolted together to assemble it.

The corner column cover 37 is illustrated in FIG. 8 and is composed of two pieces 37*a* which are bolted together. This arrangement is necessary in order to remove these members from the mold. It further demonstrates how the structural parts can be joined with bolts to form various compound shapes that cannot be formed in a single mold.

Figure 9:
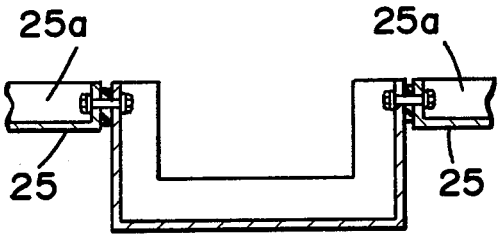
FIG. 9 is a cross-section of a regular column cover.

FIG. 9 illustrates an intermediate column cover. Like the corner cover 37, it is bolted to the vertical panels through its flanges, panel 25 being the one illustrated in the drawing. All the aforedescribed joints include an elastomer gasket 50 between the bolted flanges.

Figure 10:
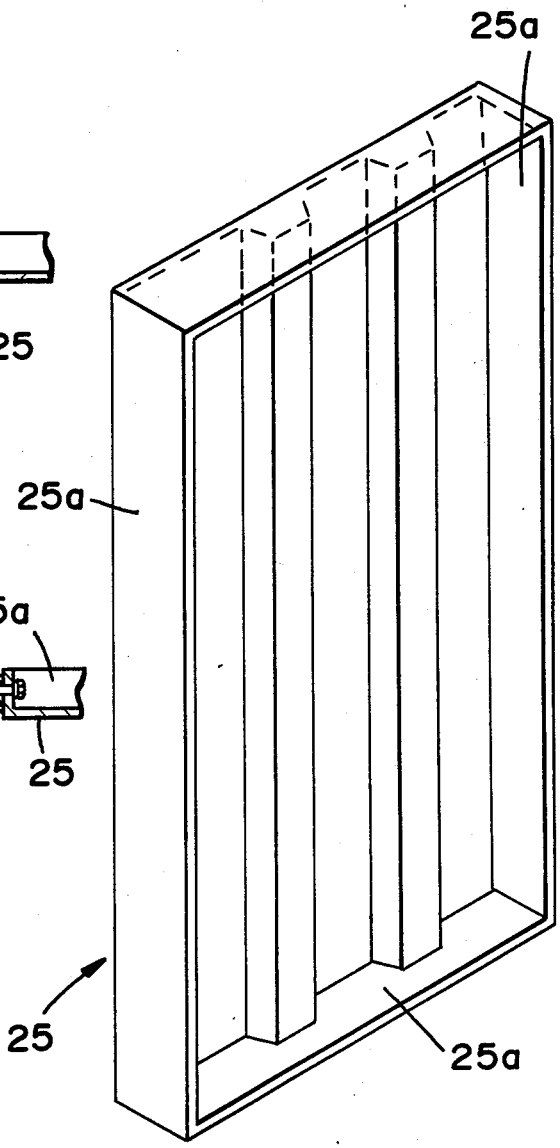
FIG. 10 is a perspective of a typical panel structure made according to this invention.
Figure 11:
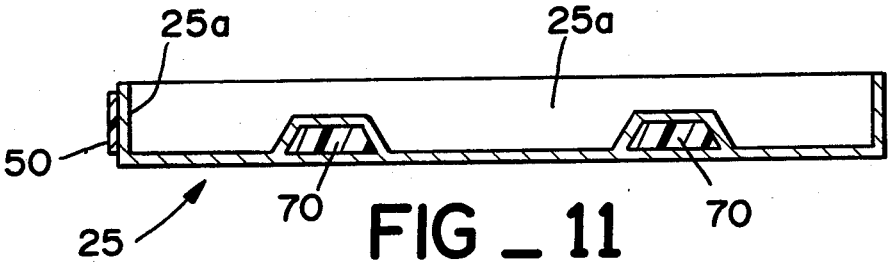
FIG. 11 is a cross-section of the GFRC panel shown in FIG. 10.

The basic panel construction is shown in FIGS. 10 and 11. Illustrated is panel 25 which has the right antled flanges 25*a* at the edges. This panel can be formed by spraying a slurry into a female mold until the desired wall thickness is achieved, then adding elongated foam or other types of battens 70 and overspraying the battens with the same slurry so that it becomes monlithic with the back of the panel, best shown in FIG. 11. The flange height should be between three (3) and six (6) inches and at least two (2) inches minimum height and have a thickness of from ½ inch to ⅜ inches and a minimum of at least ½ inch to have satisfactory panel averaging 10 pounds per square foot. The interior corners between the face of the panel and the flanges should have a minimum radius of ½ inch.

It is important that the flanges be of a thickness and a depth to provide the necessary sheer and tensile strength so as to enable these panels to transfer earthquake and wind loads directly by the foundation. The wind loads (lateral loads) are carried by the adjacent framework structure.

EXAMPLE OF PANEL-FORMULATION

To make the panels described above, the following formulation was utilized to construct a series of panels for a building structure and for test purposes. For each 3.75 cubic feet of slurry mix the proportions of the main ingredients were:

282 pounds of cement;

45 pounds of lightweight aggregate consisting of 36 pounds of diatomaceous earth (fine) and 9 pounds of Vermiculite ®;

140 lbs. water.

Included in the mix were additives consisting of 2.25 ounces by dry weight of pumping aid and 36 ounces of Alicite ®. The mix design requires at least fifty (50) percent cement by weight.

To cast the panels the resulting slurry was sprayed on to the mold while simultaneously incorporating by spray five (5) percent by weight of the wet mixed slurry of alkaline resistant fiber glass. The minimum fiberglass content is four (4) percent by weight. It can be increased to six (6) if design criteria requires greater strength. In some cases the resulting panels were rolled or otherwise compacted from the backside (spray side of the panels) to increase their density.

To carry out tests, a panel ½ inch in thickness was formed as described above and test specimens were cut therefrom. This panel was cured seven days by moist cure. The tests were conducted 28 days after the panel was sprayed up, per ASTM specimens.

FLEXURE

From this panel specimens taken therefrom and were cut to dimensions of ½ inch thickness, 2 inches in width, and 10 inches in length for beam testing to obtain the average flexural strength of the specimens. Six identical specimens were used in the ASTM C-78 3rd point loading procedures. Under these tests, it was found that the specimens yielded at 1,000 psi and failed at 1,750 psi based on an average of all six specimens tested.

BOLT PULL-OUT

In order to determine the panel's acceptability for the current application, bolt pull-out tests were made to determine the shear and tensile strengths of the flanges. To conduct this test, specimens were cut from the panel prepared as described above to dimensions of ½ inch by 6 inches by 8 inches. In each of these specimens a 7/16 inch hole was drilled with the center of the hole located 1½ inch from the edge of the specimen. A ⅜ inch bolt was inserted in the hole and thereafter the specimens were pulled against the bolt, i.e., in a direction normal to the axis of the bolt.

The average pull-out force for six specimens tested was 1,075 pounds.

TENSILE

To rate the panels for tensile strength, ½ inch thick specimens were notched to form a center section therein to provide a one square inch neck and were then tested under tension. The average strength of the six specimens was 710 pounds per square inch.

COMPRESSION

Also, the compressive strength of this mix was tested using specimens cut from a panel prepared as described above to the following dimensions: ½"×2"×4".

These specimens were tested on edge and the average compressive strength of six specimens was 4,180 pounds per square inch.

EARTHQUAKE

Next, to test the earthquake loads, two panels were bolted, with two bolts each, to a foundation and arranged to stand vertically without other support. Thereafter, a lateral pull of 1,100 pounds was placed on the three-panel structure at a height of 8 feet. On this static test, no failure was observed and information obtained therefrom was used to calculate earthquake design criteria.

Calculations on the use of modular panel system in a three-story building, 12 feet per story, for a total of 36 feet in height:

(A) The panels are bolted to connections to the girts which are spaced a maximum of 8 feet on center in the vertical direction.

(B) The bottom panels are connected directly to the foundations where the dead load of the panels is transferred to the foundation and not carried by the frame.

Forces and stresses in the panel and connections were computed, for a design check, and are shown as below:

(A) Stress due to compressive self load and wind load of 25 psf:

Compressive stress=239.4 psi

Tensile stress=194.7 psi

Test results of specimens described above demonstrated an available compressive strength of 4,180 psi and a tensile strength of 710 psi, indicating adequate safety factors for design.

(B) Stress on bolted connections of a 4 feet×8 feet panel with bolt holes one (1) inch from edge:

Wind load per panel=800 pounds.

Tests indicate 800 pounds for failure of a ⅜ inch bolt on pullout when center of the bolt is 1 inch from the edge.

Wind load reaction for 4 feet=8 feet panel equals 800 pounds per panel; Design criteria would dictate 4 bolts per panel distributed with two (2) at the top and two (2) at the bottom for alignment and to facilitate erection to provide a safety factor of 4.

Panel deflection: Allowable deflection to span ratio=1/360.

Under a wind load of 25 psf, maximum deflection was 0.05 inches. Therefore, the deflection to span ratio is 1/1,925, which is well within the limits of design criteria.

Earthquake forces are based on "*The Uniform Building Code*" of 1979 edition, §2312(g), wherein maximum earthquake load equals 0.3 g. Allowing a factor of 1.33 for connection design (§2312(j) 3C), earthquake load equals 0.4 g, i.e., 102 pounds (assuming panel weight of 8 pounds per square foot).

Tests of a 4 feet×8 feet panel bolted to the foundation and subjected to an inplane pull indicated a pullout failure of 1,100 pounds applied to the panel at its 8 feet height. This gives a factor of safety of about 10.8 which is overly adequate.

When subjected to an out-of-plane earthquake, force per bolt=51 pounds. This gives a factor of safety of about 15.7 which is quite adequate also.

*Design for Earthquake Load.* Per UBC 1979, maximum earthquake load, $F_p=AIC_pW_p$ (see 2312(g)) where $Z=1$(§2312(c))

$I=1.0$(§2312(j) 3C)

$C_p=0.3$(Table 23-J)

$F_b=1\times1\times0.3\ W_p$

For connector design, use a factor of 1.33 per UBC 1979 §2312(j) 3C.

Therefore, earthquake design load transferred to foundation is calculated as follows:

$F_p=1.33\times0.3\ W_p$ $W_p=8\#\times4'\times8'=256$ pounds.

$F_p=0.4\times256\times102$ pounds.

(A) Earthquake load perpendicular to the plane of the panel.

Load per bolt=102/2=51 pounds.

Safety factor=800/51

(B) Earthquake load in plane of the panel test indicated failure load of 1,100 pounds with two bolts at the bottom.

Safety factor=1,100/102=10.8

Figure 6:
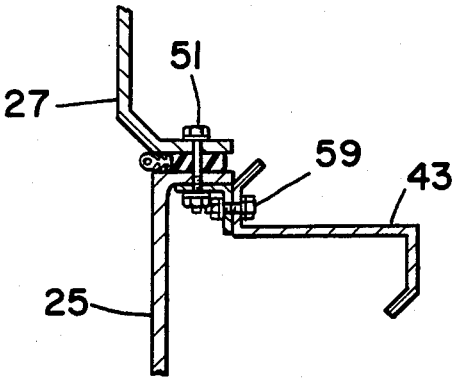
FIG. 6 is an enlarged section of the joint between the steel framework and the self-supporting wall.

Once the composite wall is in place, the joints between the several panels is further sealed. This is accomplished by forcing into the gap a polyethylene back-up rod and applying sufficient sealant to fill the joint level with the panels' surface. Alternatively, a compound seal such as shown in FIGS. 6 and 7 can be used.

Having described my invention, I claim:

1. An improved flanged cementitious and glass fiber reinforced building panel unit for assembly into a self-supporting unit by bolting through a flange of said panel comprising a generally rectangular panel structure with a thickness of at least ⅜ inch consisting of glass fiber reinforced concrete containing from four (4) to six (6) percent glass fiber by weight, at least fifty (50) percent of cement by weight and aggregate said aggregate consisting of diatomaceous earth and Vermiculite, said panel structure having at least one integral flange along one of its edges, said flange having a thickness at least equal to the panel structure thickness, and said flange angularly disposed to the surface of said panel structure.

2. The improved building panel unit defined in claim 1 wherein the panel includes at least two flanges along two of its edges, each of said flanges angularly dispsoed to the surface of said panel.

3. The improved building panel unit defined in claim 1 wherein the panel structure includes four flanges, one of said flanges along each of its edges and two of said flanges joined to one another at each corner of said rectangular panel structure, each of said flanges angularly disposed to the surface of said panel.

4. The improved building panel unit described in claim 1 wherein the height of the flange above the inner surface of the panel structure is at least 2 inches and there is a minimum radius of ½ inch at the interior joint of said panel and said flange.

5. The improved building panel unit defined in claim 1 wherein the flange height above the interior surface of the panel structure is between at least two (2) and six (6) inches in height.

6. The improved building panel unit defined in claim 1 wherein the panel structure surface includes a relief design in its exterior surface to enhance its aesthetic appearance.

7. The improved building panel unit defined in claim 1 wherein the panel structure includes an integrated rib for reinforcing it formed of the same material as said panel structure, said rib having said material disposed over an elongated battern of a lightweight material to form a boxlike structure.

8. An improved self-supporting wall comprising at least two flanged, cementitious panel units, each of each panel unit comprising a rectangular panel structure with a thickness of at least ⅜ inch consisting of glass fiber reinforced concrete containing approximately four (4) to six (6) percent glass fibers by weight, at least fifty (50) percent by weight of cement and aggregate said aggregate consisting of diatomaceous earth and Vermiculate, said panel structure having at least two integral flanges along two of its noncontiguous edges, said thickness of said flanges at least equal to the thickness of said panel structure, and each of said flanges oriented angularly to the surface of their respective panel structure and formed integral therewith, said wall formed with bolt means joining said two panels together along at least one of their respective contiguous flanges, an adjacent vertical framework, and connecting means pivotably attaching said panels to said framework, said connecting means allowing two degrees of freedom of movement in the plane of the wall.

9. The improved self-supporting wall defined in claim 8 wherein an elastomer gasket is placed between the flanges of the respective panel units before said panel units are joined with bolt means passing through their respective, contiguous flanges.

10. The improved self-supporting wall defined in claim 8 wherein more than two panel units are utilized to form the wall, all of said panel units being joined together through their respective contiguous flanges with the bolt means.

11. An improved self-supporting building wall composed of cementitious panels comprising at least two separate panel units each of said panel units consisting of a rectangular panel structure of glass fiber reinforced concrete, each of said panel units having at least two flanges along its opposite edges, said flanges oriented angularly to the surface of its panel structure and formed integral therewith, and said panel structures joined along at least one of their flanged edges to another panel structure by bolt means joining said flanges together to form said modular wall, an adjacent vertical framework and connecting means pivotably attaching said panels to said framework, said connecting means preventing movement of said modular wall toward and away from said framework.

12. The self-supporting wall defined in claim 11 wherein an elastomer gasket is placed between said flanges which are joined with bolt means.

13. The self-supporting wall defined in claim 11 wherein more than two of said panel units are used to form the modular wall and at least one of the panel structures being joined to two other panel structures with bolt means through their flanges securing one of its flanged edges to one of the flanged edges on each of said other panel structures by said bolt means extending through the flanges.

14. The self-supporting wall defined in claim 11 wherein at least one of the panel structures has an integral rib means for reinforcing said panel structure, said rib means formed of the same material as said panel structure by encapsulating a mold means on said panel structure with said material to shape said rib means in a box-like structure.

15. An improved building structure having at least one wall formed of a plurality of cementitious panels which are bolted together, said one wall comprising:

a foundation;

a building framework operable to support the roof and wind loads of said buildings assembled on said foundation;

a plurality of cementitious glass fiber reinforced panels, each of said panels consisting of a rectangular panel structure formed of glass fiber reinforced concrete, each of said panels having at least two integral flanges along its edges, each of said flanges oriented angularly to the surface of said panel structure, said panels being stacked vertically on said foundation in rows whereby a first row of said panels supports the weight of the second row of said panels when the flanges of said panels are aligned with one another;

gasket means separating the flanges of said panels operable to provide for expansion and contraction of said panels;

bolt means extending through the flanges of said contiguous panels and operable to join said panels into a wall structure composed of a plurality of said panels;

alignment means connecting said panels to said framework of said building at the top of the panels and at least one intermediate point between top and bottom of said wall being operable to hold the vertical alignment of said panels in the plane of said wall structure, said alignment means allowing two degrees of freedom of movement between the panels and the framework but restricting any lateral movements therebetween normal to the plane of the resulting wall structure; and means attaching the bottom of said lower row of said panels to the foundation.

16. The building structure defined in claim 15 wherein more than one wall of the building is made of a plurality of the cementitious panels and connected frameworks.

17. An improved building structure having at least one wall formed of a plurality of cementitious panels which are bolted together, said one wall comprising:

a foundation;

a building framework operable to support the roof and wind loads of said buildings assembled on said foundation;

a plurality of cementitious glass fiber reinforced panels, each of said panels consisting of a rectangular panel structure formed of glass fiber reinforced concrete having at least four (4) percent glass fiber by weight and having at least two integral flanges on its opposite edges which flanges are at least equal to the thickness of said panel structure and oriented angularly to the surface of said panels structure, said panel being stacked vertically on said foundation in rows whereby a first two of said panels supports the second row of said panels when the flanges of said panels aligned with one another;

gasket means separating the flanges of said panels operable to provide for expansion and contraction of said panels;

bolt means extending through the flanges of said contiguous panels and operable to join said panels into a vertical wall structure composed of a plurality of said panels;

alignment means connecting said panels to said framework of said building operable to fix the vertical alignment thereof in the plane of said wall structure, said alignment means allowing two degrees of freedom of movement between the panels and the framework but restricting any lateral movements therebetween normal to the plane of the resulting vertical wall structure; and means attaching said lower row of said panels to the foundation.

* * * * *